US009004142B2

(12) United States Patent
Marocco

(10) Patent No.: US 9,004,142 B2
(45) Date of Patent: Apr. 14, 2015

(54) BLIND ASSEMBLY WITH TWO BLIND HEAD RAIL

(75) Inventor: Mario M. Marocco, Toronto (CA)

(73) Assignee: Maxxmar Inc., Toronto, Ontario (CA)

( * ) Notice: Subject to any disclaimer, the term of this patent is extended or adjusted under 35 U.S.C. 154(b) by 208 days.

(21) Appl. No.: 13/506,538

(22) Filed: Apr. 26, 2012

(65) Prior Publication Data

US 2012/0291964 A1 Nov. 22, 2012

Related U.S. Application Data

(63) Continuation-in-part of application No. 13/374,952, filed on Jan. 25, 2012, which is a continuation-in-part of application No. 13/067,189, filed on May 16, 2011.

(51) Int. Cl.

| | |
|---|---|
| ***E06B 9/264*** | (2006.01) |
| ***E06B 9/40*** | (2006.01) |
| ***E06B 9/262*** | (2006.01) |
| ***E06B 9/50*** | (2006.01) |
| *E06B 9/24* | (2006.01) |

(52) U.S. Cl.

CPC . *E06B 9/40* (2013.01); *E06B 9/262* (2013.01); *E06B 9/50* (2013.01); *E06B 2009/2405* (2013.01); *E06B 2009/2452* (2013.01); *E06B 2009/405* (2013.01)

(58) Field of Classification Search

USPC ..... 160/108, 89, 168.1 V, 900

IPC ..... E06B 2009/2423,2009/2429, 2009/2435, E06B 2009/2447, 2009/2452, 2009/264, E06B 2009/405

See application file for complete search history.

(56) References Cited

U.S. PATENT DOCUMENTS

| | | | | | |
|---|---|---|---|---|---|
| 927,090 | A * | 7/1909 | Anderson | 160/110 |
| 1,601,665 | A * | 9/1926 | Alphin | 160/112 |
| 1,636,601 | A * | 7/1927 | Givens | 160/25 |
| 2,604,159 | A * | 7/1952 | Wright | 160/172 R |
| 4,114,233 | A * | 9/1978 | Hamilton | 16/95 R |
| 4,724,885 | A * | 2/1988 | Chang | 160/89 |
| 5,205,334 | A * | 4/1993 | Judkins | 160/89 |
| 5,392,833 | A * | 2/1995 | Ohanesian | 160/89 |
| 5,505,418 | A * | 4/1996 | Corcoran | 248/254 |
| 5,520,235 | A * | 5/1996 | Coleman | 160/89 |
| 6,712,115 | B2 * | 3/2004 | Judkins | 160/32 |
| 7,059,377 | B2 | 6/2006 | Nien | |
| 7,293,596 | B2 * | 11/2007 | Nien | 160/89 |
| 2010/0307698 | A1 * | 12/2010 | Perkowitz | 160/108 |

* cited by examiner

*Primary Examiner* — David Purol

(57) ABSTRACT

A blind for a building opening, having; an upper blind roller, located in an upper region of the head rail, a lower blind attachment located in a lower region of the head rail, an upper blind stored on the upper blind roller, a lower blind stored on the lower blind attachment, upper and lower blind control mechanism operable to operate the blinds and in which the upper blind roller is located in an upper plane in the head rail and the lower blind attachment is located in a lower plane, the axes being displaced vertically from one another, and in which the upper blind depends down beside the lower blind attachment, and in which the lower blind depends down alongside said upper blind, so as to provide a head rail having a slim, aesthetically pleasing profile.

6 Claims, 15 Drawing Sheets

BLIND ASSEMBLY WITH TWO BLIND HEAD RAIL

This application is a Continuation in part of application Ser. No. 13/374,952 filed Jan. 25, 2012, title Blind Head Rail with Control Guides, Inventor Mario M Marocco, which was a Continuation-in-Part of application Ser. No. 13/067,189 filed May 16, 2011, title Double Blind and Head Rail, Inventor Mario M Marocco. The invention relates to blinds for windows, in which there are at least two panels of blind material, which may hang double. The panels can be adjusted for various light and shade effects, or can be rolled up into a headrail.

FIELD OF THE INVENTION

Background of the Invention

In the past, conventional blinds for windows have typically been either venetian style blinds with transverse strips, or so called vertical blinds. These blinds could have a mechanism whereby the strips could be rotated between closed and open positions. However in the open position, in which light is transmitted into the room, there was also a loss of privacy. In the closed position, the light was obscured.

Other blinds are known which simply consist of a panel, of thick flexible material, wound onto a roller in a headrail. The material can be pulled down for privacy, and to obscure the light, or raised, to allow passage of light, but with loss of privacy.

Recent developments in blind design have found that consumers are interested in obtaining blinds with a greater variety of light and shade effects, but which none the less provide for privacy.

For this purpose, a continuous sheet of blind material may be provided, which hangs down double, over the window opening, and forms a loop. The sheet is preferably somewhat translucent and is stored on a roller in the head rail. The free end of the sheet is fixed up in the head rail, and the other end of the sheet is attached to the roller in the head rail. This material is light permeable, but provides privacy. For example the material may have alternating bars or strips of more and less translucent material. When hanging in a loop the material will allow more light through the more translucent lighter strips and less through the less translucent darker strips. By adjusting the loop it is possible to allow more light into the space.

But by slightly readjusting the loop so as to bring the darker strips into registration, it is possible to reduce the light in the space.

The blind may incorporate a bottom rail which is weighted to keep the loop hanging down. A free running guide roller may be incorporated in the bottom rail. The loop runs freely, in the bottom rail, around the guide roller. In this way the material can be adjusted, or can be retracted right up into the head rail.

In another embodiment a second blind panel is stored in the head rail and is formed of opaque material. When complete light exclusion is required this second panel can be lowered.

In this embodiment both blind panels are stored in the same head rail, on separate rollers.

The design of a blind header rail providing two rollers, for handling two such panels, and which may provide for relative movement between one portion of the first panel and another portion, and also the provision of the second roller for the second panel, presents numerous problems. In the first place the head rail must be compact and aesthetically pleasing.

Desirably the blind head rail shall occupy no more space, or only slightly more space at the top of the window opening than previously known blinds. The operation of the separate blind panels must be simple and capable of being operated by either manual controls, or in the case of more complex designs by means of power controls, and even remotely operated power controls.

The rollers will preferably be arranged as upper and lower rollers. Each roller would carry a blind panel.

The upper blind, on the upper roller, will be guided to pass around the lower roller, and separate from the lower blind, on the lower roller.

Where the lower blind is a double panel, with a weighted bottom rail, the lower blind passes around a free running guide roller within the bottom rail. When the lower blind is retracted up, the material continues to roll freely around the guide roller in the bottom rail.

In addition, it is also desirable to provide mechanism for the upper roller and mechanism for the lower roller in the blind head rail by which either or both of lower and upper panels can be raised up out of the window opening, so as to leave the window opening clear and free of the blind all together.

The blind controls are usually chains or cords, hanging down from the headrail, and controlling the rollers.

One of the problems experienced with such cords is that some space must be allowed for the cord loops to hang beside one edge of the blind panels.

This space along one vertical edge of the blind panels, then allows some light in, and the blind fails to obscure all light.

Another problem is that when an operator manipulates the cords, the edges of the panels gradually become damaged. The appearance, and life, of the blind is therefor impaired.

Another problem occurs from possible friction within the head rail.

Since there are two blind panels, and two blind panel rollers, in the head rail, it is desirable to lead one blind panel in a path which mimises contact with the other blind panel. Any such contact between the two blind panels, may cause friction between them, when either panel is adjusted.

Such friction in some cases may result in some degree of damage to one or other of the panels.

In some cases a certain degree of friction may be inevitable, and may be acceptable in lower cost blinds, or may be reduced by the use of materials which generate less friction.

BRIEF SUMMARY OF THE INVENTION

With a view to achieving the foregoing desirable features, the invention provides a blind for a building opening, and having a head rail, attachable adjacent the building opening, said head rail defining upper and lower regions, and having; an upper blind roller, located in said upper region of said head rail, a lower blind attachment located in said lower region of said head rail, an upper blind stored on said upper blind roller, a lower blind stored on said lower blind attachment, upper blind control mechanism operable to lower and raise said upper blind, lower blind control mechanism operable to operate said lower blind and to lower and raise said lower blind, wherein said upper blind roller is located with an upper axis along an upper plane in said head rail and said lower blind attachment is located on a lower axis along a lower plane within said head rail, said axes being displaced vertically from one another, and wherein said upper blind is operable to depend down beside a predetermined side of said lower blind attachment, and wherein said lower blind is operable to depend down alongside but spaced from side of said upper blind, whereby to provide a head rail having a slim, aesthetically pleasing profile.

Control elements will be provided for operating both the lower and the upper blind, and guides in the head rail guide the elements to hang free of the lower and upper blinds. Preferably the upper blind is an opaque black out blind, and said lower blind is a semi translucent blind, whereby when said upper blind is raised and said lower blind is lowered, some light will pass in, and wherein when said upper blind is lowered light is substantially excluded.

The upper roller is located in an upper region of the head rail, and the lower blind attachment, which may be a linear elongate member, or a lower roller, depending on the type of lower blind, in located in a lower region of the head rail spaced vertically apart In one embodiment the lower blind is a panel formed into a loop of material, and a lower blind bottom rail is provided, and having a free running roller, and in which said loop of said lower blind panel passes around said free running roller in said bottom rail.

Preferably the invention provides such a blind in which the lower blind panel has a free end secured in the head rail, and a second end attached to the lower blind roller in the head rail. Transverse blind strips, alternating between light permeable or translucent strips, and less permeable or dark strips, are formed in the lower blind panel, at spaced intervals there across. The bottom rail provides a mass weight to hold the loop of the lower blind panel in position.

Blind panel control mechanism in the head rail enables the lower blind panel to be adjusted so that one portion of the loop moves relative to the other. During such adjustment the blind panel material passes freely around the free running guide roller in the bottom rail In this way the alternating blind strips can be adjusted between open and closed positions.

Preferably the free end of the lower panel is attached within the head rail in a position such that contact between the two portions of the looped blind panel are kept to a minimum as far as possible.

An attachment wall may be incorporated in the head rail for holding the free end of the lower panel, free from contact with either the lower blind or the upper blind.

Preferably the bottom rail has a hollow channel shaped roller housing, defining an upwardly directed open mouth, and a free running roller located in said housing, said free running roller having a diameter greater than the width of said channel open mouth whereby to trap said roller within said housing.

In order to support the lower blind, a support wall may be provided which is secured to the front of the head rail, and extends partially towards the rea, with the lower blind secured to the support wall.

A space at the rear of the head rail permits the upper blind to depend freely down behind the lower blind.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
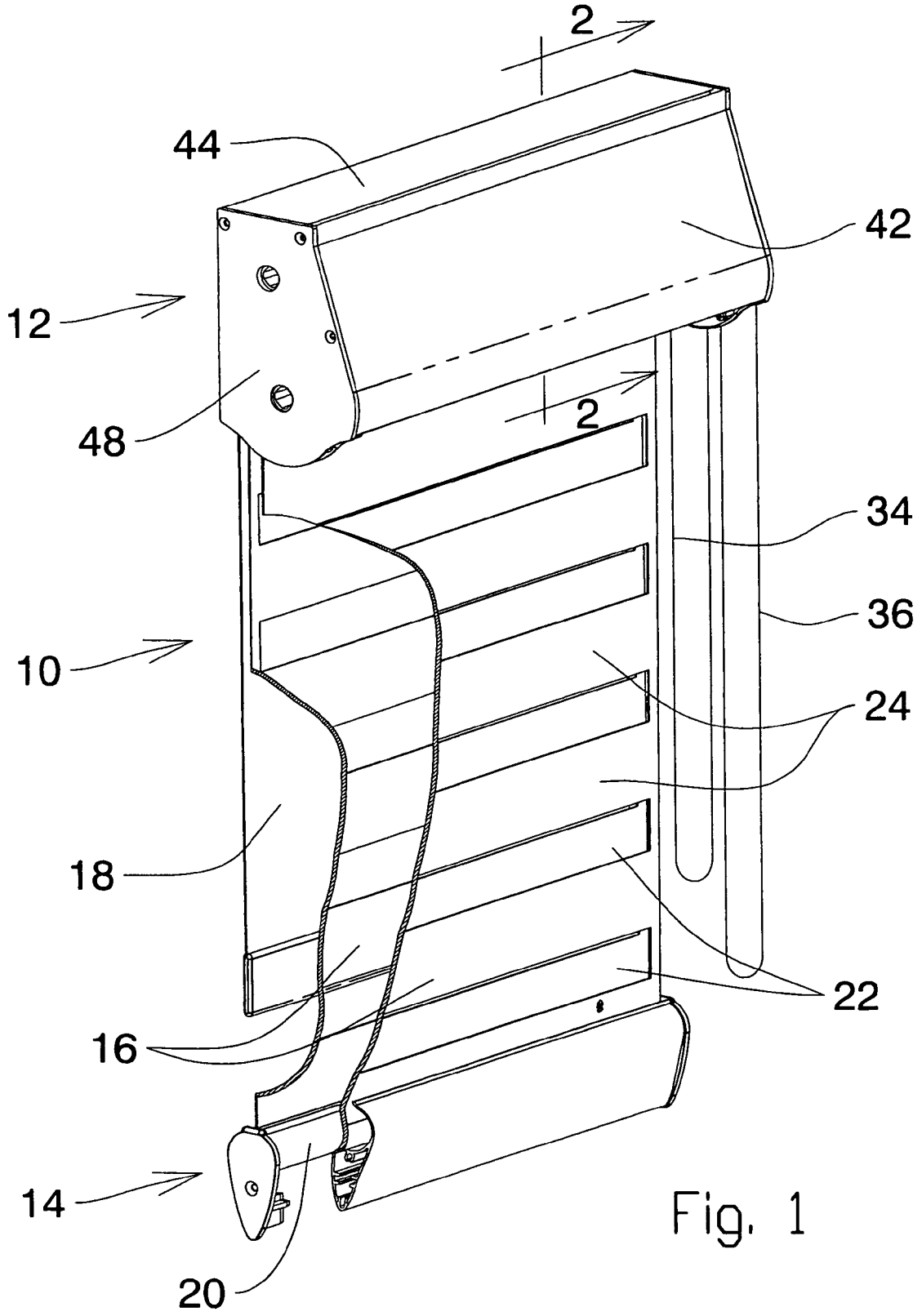
FIG. 1 is a general perspective of a typical blind illustrating the invention and showing a first looped blind panel, with alternating light and dark transverse blind strips, and a second opaque blind panel, and a head rail.

It will be seen that the blind illustrated generally as (10), comprises a head rail (12) and a bottom rail (14). The blind is typically located over a building opening such as a window.

The blind, in this first embodiment, provides a first or lower looped translucent blind panel (16) and a second or upper opaque blind panel (18). It will be seen that the first and second blind panels are supported so as to hang vertically. The second panel (18) has the usual bottom rail.

The first or lower blind is located in a lower region of the head rail, and is the lower blind.

The second blind panel is located in an upper region of the head rail, and is the upper blind.

First blind panel (16) is a continuous strip which passes around a bottom rail roller (20) in the bottom rail (14), and the free end is secured back up in the head rail (to be described below), so as to hold the looped panel in position.

As shown the front blind panel in this embodiment is a loop, so that its two portions form in effect two panel portions hanging down, one panel portion being spaced in front and the other behind.

The two panel portions can be considered as a front panel portion and an intermediate panel portion.

The second blind panel, which is the upper panel, hangs rearwardly behind the front and intermediate panel portions.

The first and second blind panels are spaced apart from one another.

The first blind panel, in this embodiment, is formed of light permeable material, which is at least partly translucent, so that light can pass through and permit at least some light to pass into the interior of the building, even when the first panel is lowered.

In order to provide for a variable lighting effect, namely a greater or lesser exclusion of light, first blind panel (16) is provided with transverse darker blind strips (22). Strips (22) are formed of thicker or darker material such that it is at least less light permeable, than the fabric of the blind panel. The strips (22) are located at spaced intervals. Between the strips (22), spaces or strips (24) of the fabric of the first panel (16) are more light permeable, thus providing alternating light and dark strips.

As shown, the first panel hangs down in a loop. At its lower end it passes freely into and out of bottom rail (14), described below. Within rail (14), the free running roller or rod (20), guides and controls the first blind material. By adjusting the loop it is possible to either align the dark strips (22) in the two parts of the loop with each other, and thus align the light strips (24) with each other. This will provide passage of light through the lighter strips. By adjusting the loop slightly, the dark strips (22) in one part of the loop can be made to align or register with the light strips (24) in the other part of the loop, providing more privacy and less light.

By suitable mechanism (described below) the first and second blind panels can be adjusted, and raised or lowered, and can also be retracted back up into the head rail (12) in order to provide a completely open area in the building opening or window.

In order to provide for these functions the head rail (12) carries an upper second panel roller (30) located in an upper region of the head rail, and a lower blind attachment, in this case a lower roller (32) which is located in a lower region of the head rail.

The two rollers define axes which are parallel, but spaced vertically apart from one another. Roller (32) is located below the roller (30).

It will be noted that the lower blind hangs from the rearward side of its roller.

Similarly the upper blind hangs rearwardly from its roller. Both blinds therefor hang an the same side of their respective rollers, which makes for a more compact aesthetically please profile for the head rail.

The two rollers are operable, in this embodiment by control elements which in this case comprise respective first and second control cords, chains or the like, (34) and (36).

Head rail (12) comprises an elongated transverse channel, preferably formed of suitable material such as thermoplastic material, or a metal extrusion, and having screw receiving mouldings (40) formed therein.

Head rail (12) defines a front cover wall (42), a top wall (44) and a back wall (46). Suitable mounting devices (not shown), for securing the blind to a building, can be secured to the back wall or top wall, depending on the fabric of the building to which it is to be attached.

At each end of head rail (12) there is an end cap (48), preferably formed of thermoplastic.

The end cap (48) defines a flat planar exterior.

Screws can be passed through the end cap and secured in screw mouldings (40) in head rail (12).

Main body (50) is formed with integral upper and lower hub bearings (54) and (56), for carrying ends of respective rollers (30) and (32).

Drives for the rollers are operated by respective control elements, in this case upper and lower control cords or chains (34) and (36). Such cords, as is well known, hang down in endless loops, and one or other of the loop portions can be grasped and drawn down, to operate the respective blinds.

The cords, in this case, are the typical metal chain cord, having metal spheres connected together by wire links, such as are well known in the art. The spheres are also commonly made of thermoplastic, in a variety of colours.

Cords of other designs are known and could be used. All such cords, whether chains, or cords of any other type are referred to herein as control elements or cords, wherever these words are used, and are deemed to include all such chains, cords, and the like of whatever type.

The cord for the upper roller hangs well forward of the edges of the first and second blind panels (16) and (18).

The cord for the lower roller hangs forward of the edges of the first and second blind panels.

Each blind roller has a groove (80) in which edges of the respective blind panels are secured.

An intermediate loop fastening wall (82) which in this case is formed of extruded metal, for example, but could be formed in other ways, is secured in a groove (80) inside the front wall (42) of the head rail (12).

The wall (82) is, in this case, removable, by sliding out of the groove. However, the wall could be permanently fastened to the head rail, or could be formed integrally with the head rail.

The fastening wall (82) extends between the upper and lower rollers (30) and (32), and terminates adjacent to but spaced from the back wall (46). A first blind panel loop fastening groove (84) is formed along the free edge of wall (82). The free end of front looped blind panel (16) is secured in groove (84), in this embodiment.

In operation the first or front panel (16) can be lowered, while the second panel (18) remains retracted.

As front panel (16) is lowered it will run around roller (20) in the bottom rail (14). If light is required then the front or lower panel can be adjusted so the dark strips (22) align with each other. This will allow passage of light through the intervening light strips. (24)

If less light is required, or for greater privacy, the front panel can be adjusted so that the dark strips line up with the lighter intervening strips.

It will be seen that the front or lower panel forms in effect two panel portions, namely a front portion and an intermediate portion, spaced from one another. Adjustment of the front and intermediate portions relative to one another, changes the lighting effect inside the building space.

For substantially complete light exclusion the second or upper blind panel (18) is lowered. However the first panel may be allowed to remain hanging down and provides a pleasing aesthetic decorative effect.

The first or lower blind panel hangs down from the rearward side of lower roller (32), clear of the control cords.

The second or upper blind hangs downwardly from the rearward side of upper roller (30), keeping it also clear of the cords.

By this arrangement the profile of the head rail can be maintained as slim as possible, and thus provide an aesthetic appearance, without obtruding into the building interior. In addition since the object of the blind itself is to control the light entering the building space, the result of keeping both lower and upper blinds to the rear of the head rail, ensures that as far as possible, light is prevented from entering, around the edges of the two panels. In other words, this arrangement keeps both blinds as close as possible to the actual window. The operation of the blind panels by the cords and the manipulation of the cords, can be managed forwardly of the two blind panels, and without contact their edges.

In addition by guiding the cord loops to hang forwardly, the blind panels can fill the full width of the building opening or window, and thus provide maximum privacy, and exclusion of light.

Figure 5:
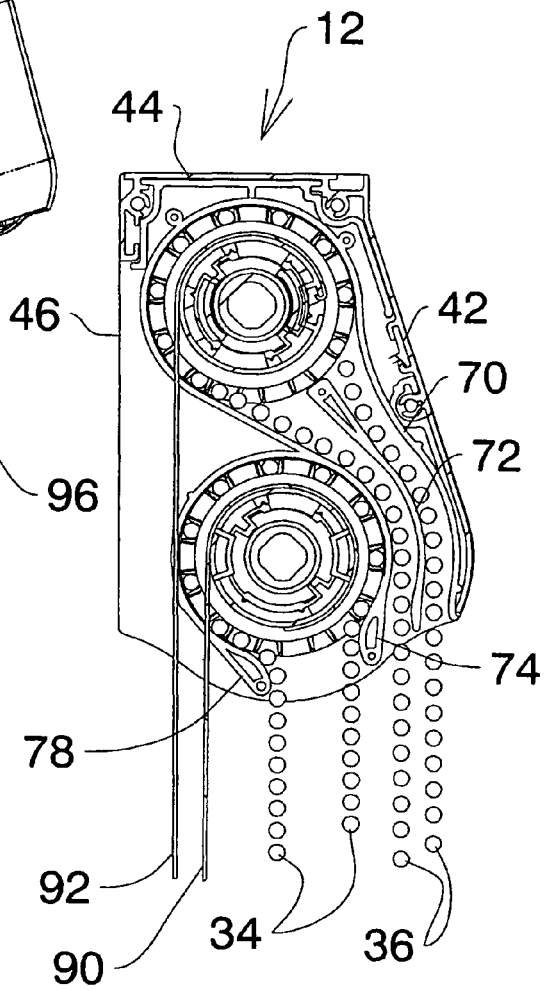
FIG. 5 is a section corresponding to FIG. 2 showing another embodiment.

A somewhat simplified embodiment is shown in FIG. 5.

In this case the front blind panel (90) is a single sheet. There is no loop.

The lower end is attached to a bottom rail (92).

Figure 2:
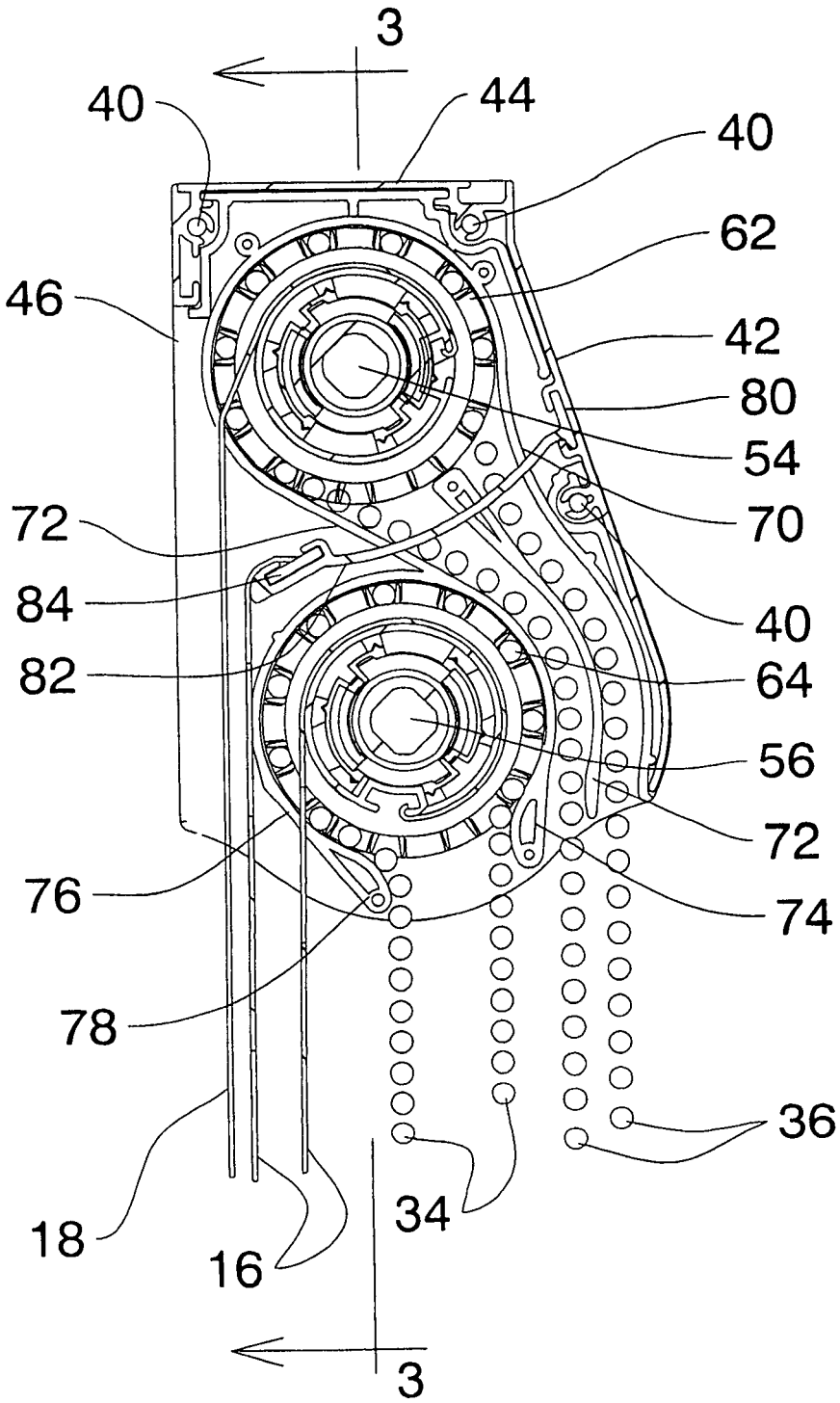
FIG. 2 is a section along line 2-2 of FIG. 1.
Figure 3:
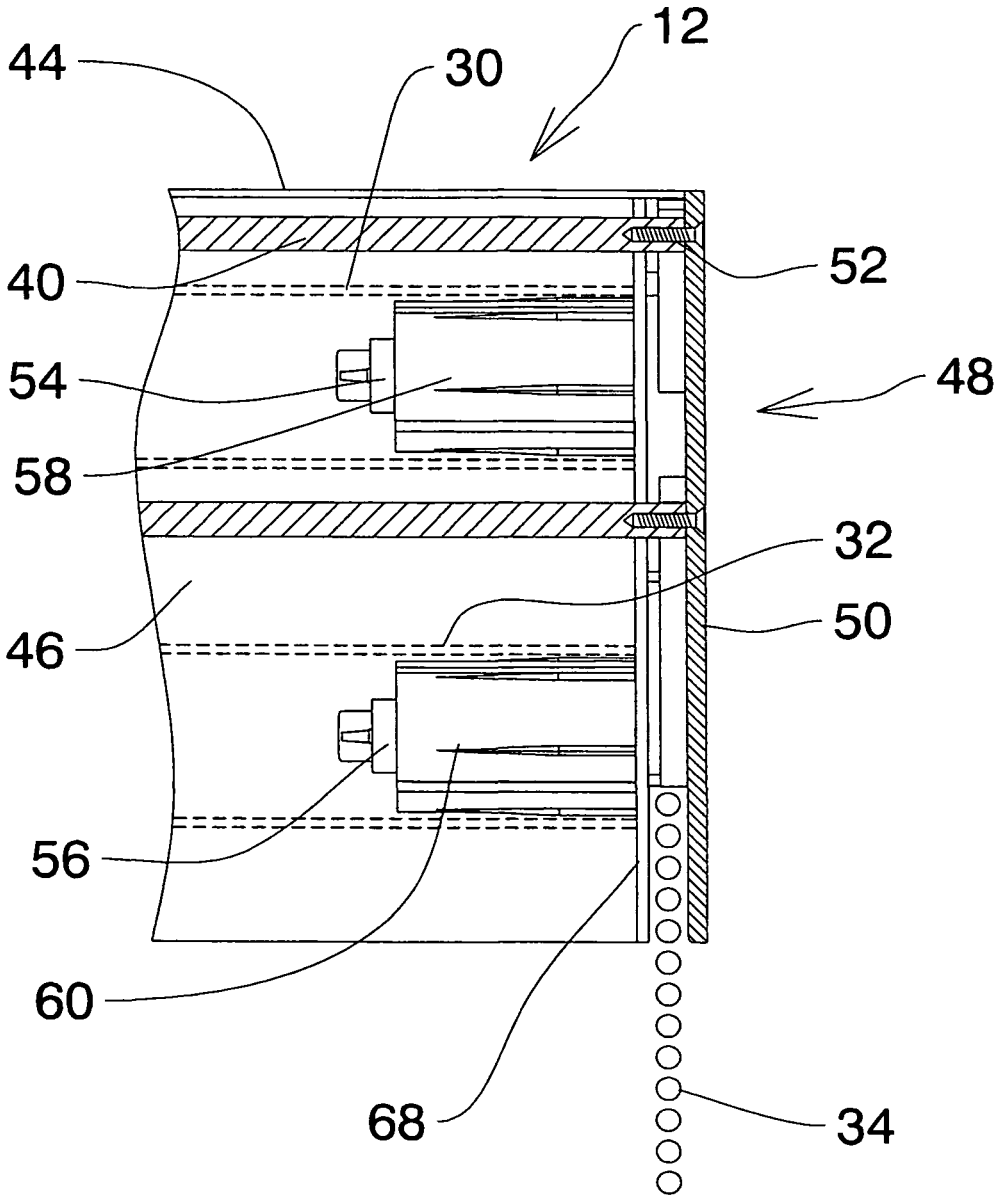
FIG. 3 is a section along line 3-3 of FIG. 1.
Figure 4:
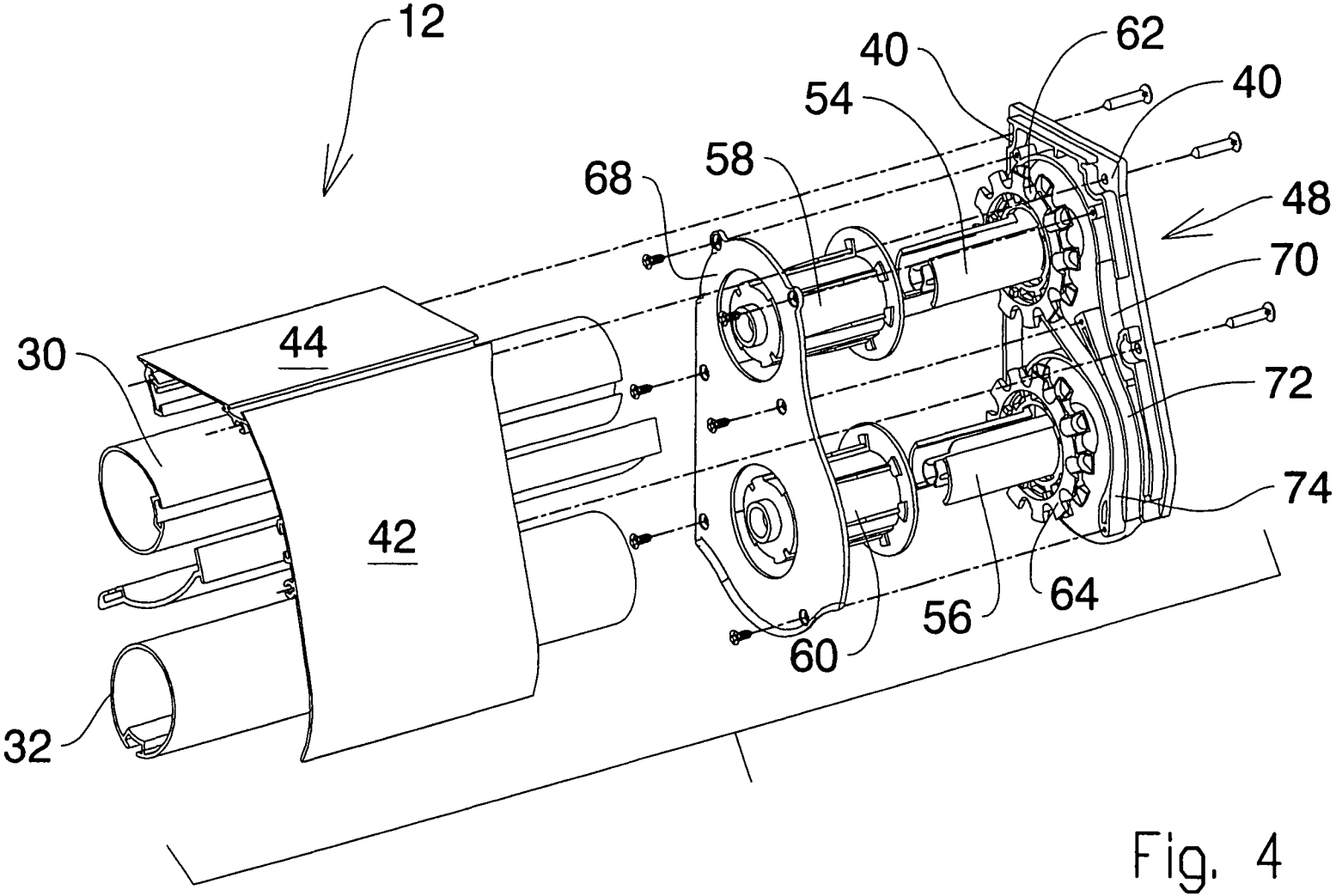
FIG. 4 is an exploded perspective of one end of the head-rail.

The fastening wall extrusion (82) of FIG. 2 has been removed as it is not required.

There is no dead end of the front panel (90) to be secured, in the head rail.

The second panel (94) is similar to the second panel of FIG. 2.

The control cords and guides are the same as in FIG. 2, and have the same reference numbers.

Figure 6:
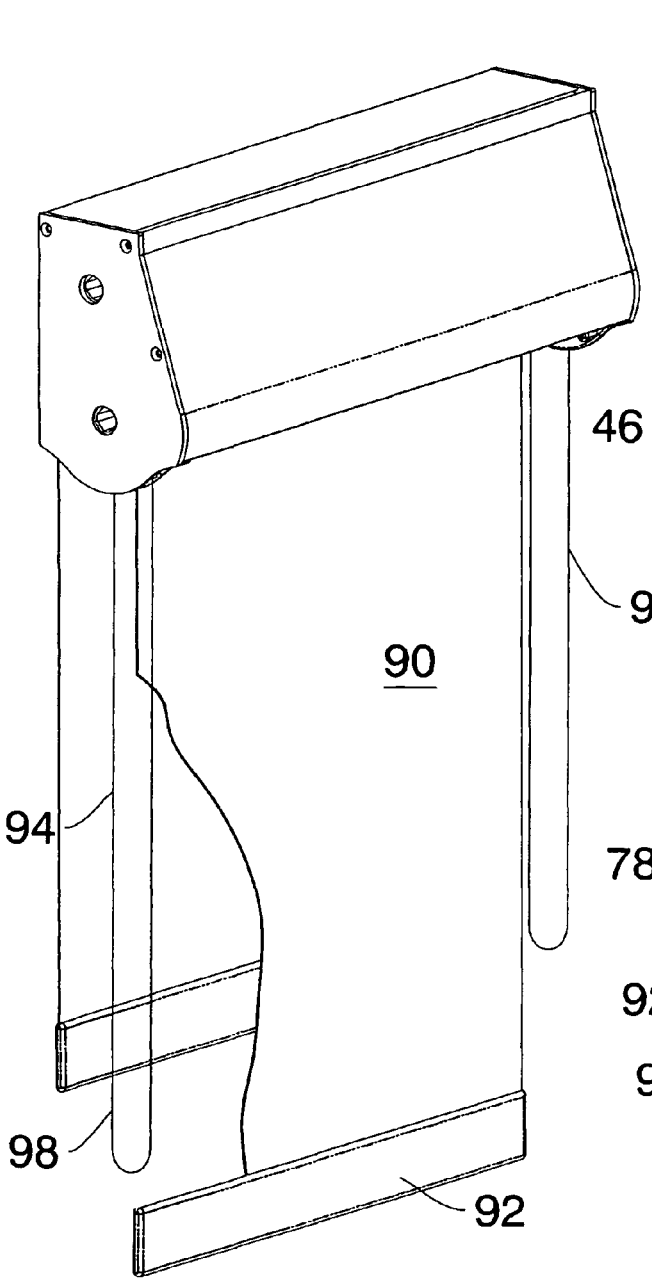
FIG. 6 is a perspective of another embodiment.

The cords are guided, as before, forwardly of the edges of the first and second panels Another possible variation is shown in FIG. 6.

In this case the front blind panel control cord (96) is shown located at one end of the head rail, and the control cord (98) for the second panel is located at the opposite end of the head rail.

In this case the end caps (100) are the same as in FIG. 2, and both sets of control cords are guided forwardly of the edges of the two blind panels.

It is possible that the same headrail can be used for a simpler blind with only a single blind panel. In such a case there would be only one cord loop (not shown), but it would still be guided by the appropriate ribs and hang forwardly of the blind panel, so as to avoid damage to the edge of the panel.

The use of the forward guiding of the control cords also has the result of permitting the blind panel, or panels, to be made to the full width of the window opening, and thus provide for more effective light exclusion, when required.

The head rail can be adapted for use with a variety of different types of blind designs.

Figure 7:
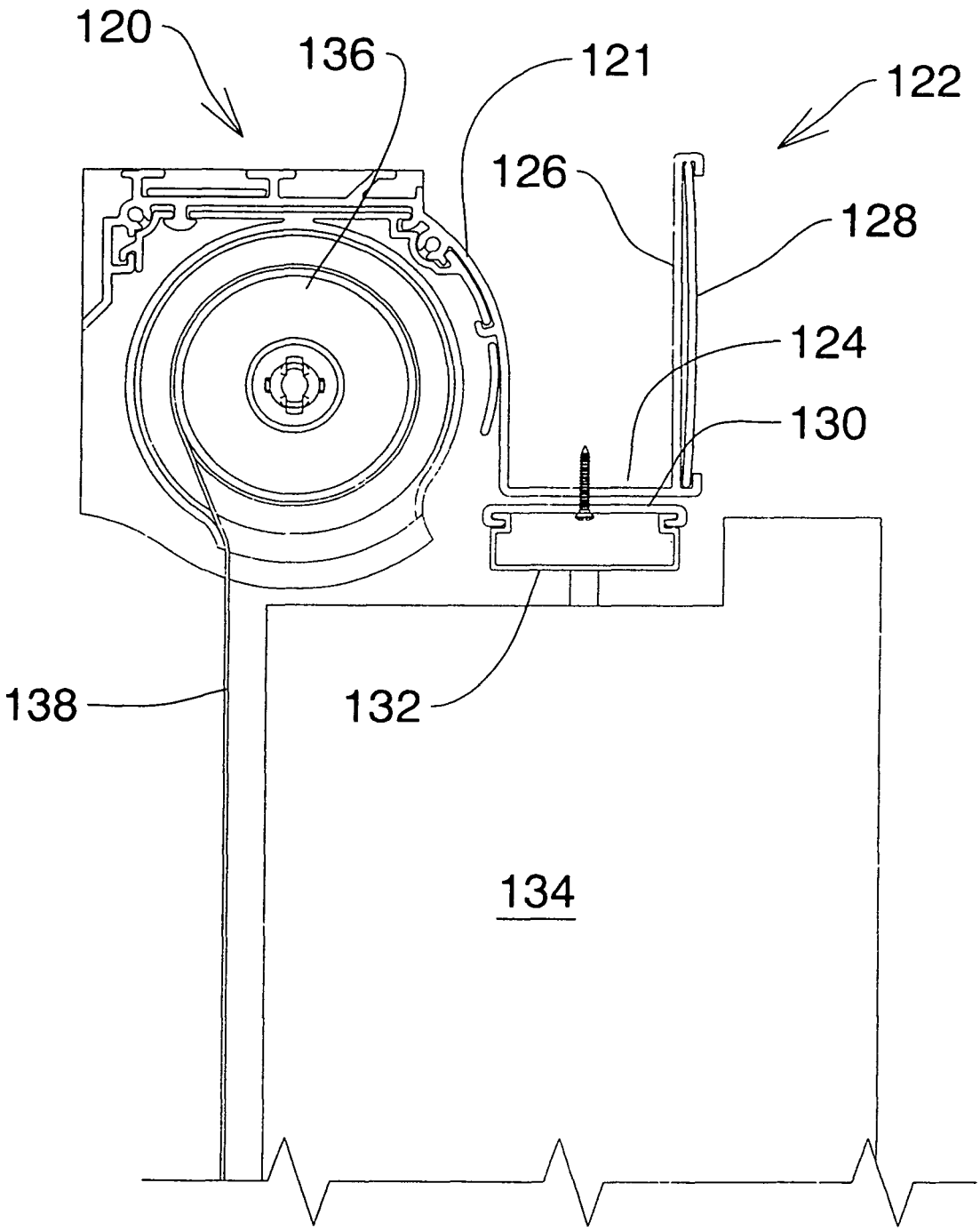
FIG. 7 is a side elevation of another embodiment; showing a vertical strip blind as the front panel, and a dark effect material as the second panel.

FIG. 7 shows the head rail (120), modified somewhat to support a typical vertical blind.

Thus head rail (120) has a front wall extension (122) formed integrally.

Extension (122) is of generally L-shaped section, having a horizontal support wall (124) and a vertical front wall (126).

Any suitable trim strip (128) can be supported in vertical wall (126) in known manner.

A lower blind attachment, in this case a transverse elongated linear blind track (130), of known design can be simply secured to the underside of support wall (124).

Trolleys (132) on track (130) carry vertical strips (134), in known manner Such vertical blinds can be operated by cords, or by wands, in known manner.

Within head rail (120) a single upper roller (136) carries a second upper blind panel (138). This is formed of opaque dark effect material.

Suitable cords (not shown) are provided for operation of roller (136), being guided forwardly of the edge of panel (138) by guides such as shown in FIGS. 1 to 6.

Thus the vertical strips forming the first blind panel can be deployed to provide some privacy, and some light exclusion, as desired.

By this arrangement the upper blind panel can hang freely down in the rear area of the head rail, without interference from the lower blind carried on the support wall (124) When darkness is required the second panel (138) can be lowered.

Figure 8:
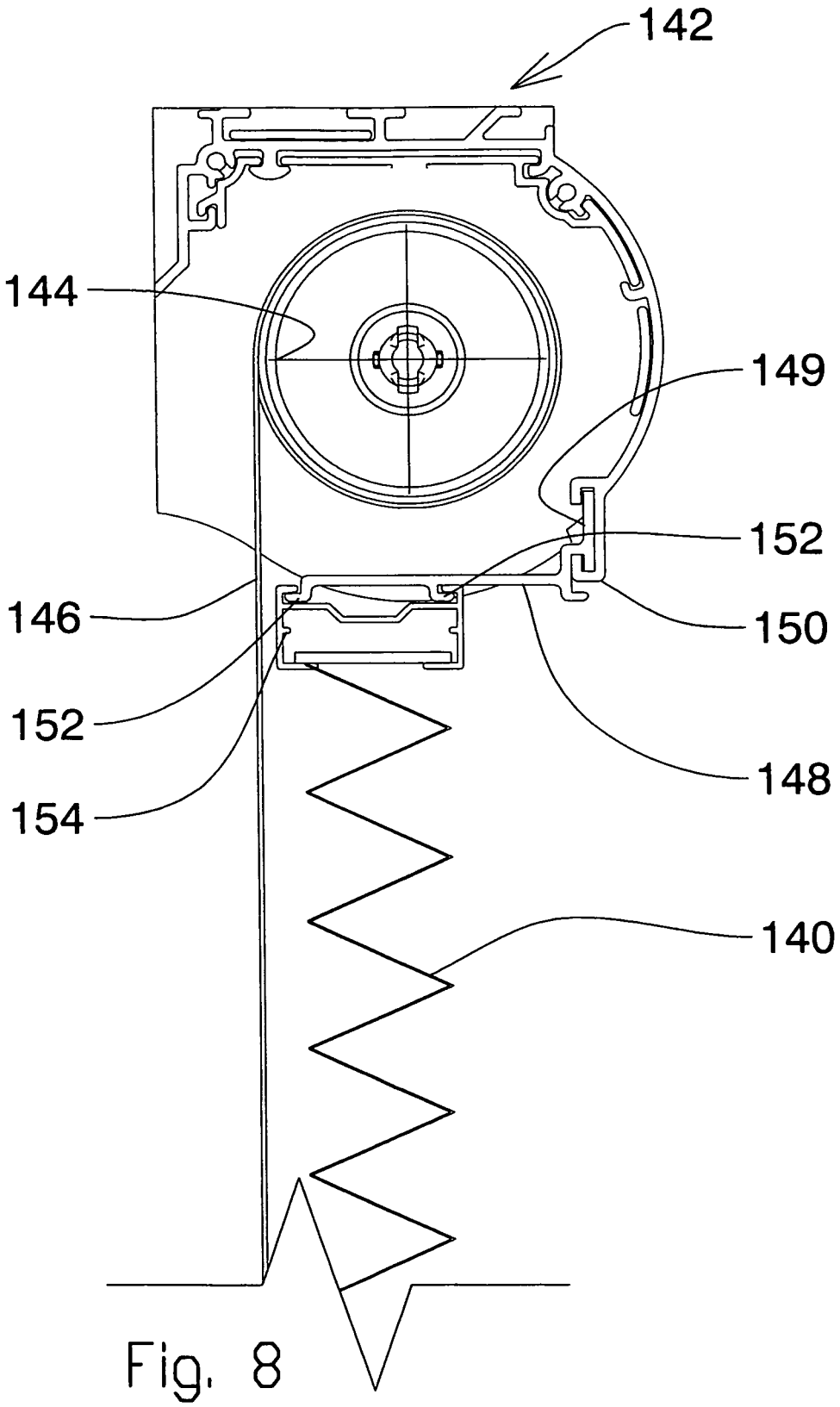
FIG. 8 is a side elevation of another embodiment showing a concertina material as the front panel and a dark effect material as the second panel.

FIG. 8 shows another embodiment. In this case the front or first panel is of concertina type blind material (140), typically made from semi translucent material.

In this case the head rail (142) has a single roller (144) for the second or upper panel (146), similar to FIG. 7, being formed from opaque dark effect material. The front or lower panel is supported by a lower blind attachment, in this case by a horizontal support wall (148).

Wall (148) is attachable to front wall of head rail (142), by a slide flange (149) fitting in a channel (150) formed in head rail (142).

The support wall (148) defines two ridges (152), and a rectangular tubular blind housing (154) is slideably attached to the ridges. In this way the attachment of the lower concertina type blind leaves the rear area of head rail (142) clear of obstruction, and the upper blind panel can hang down freely.

Figure 9:
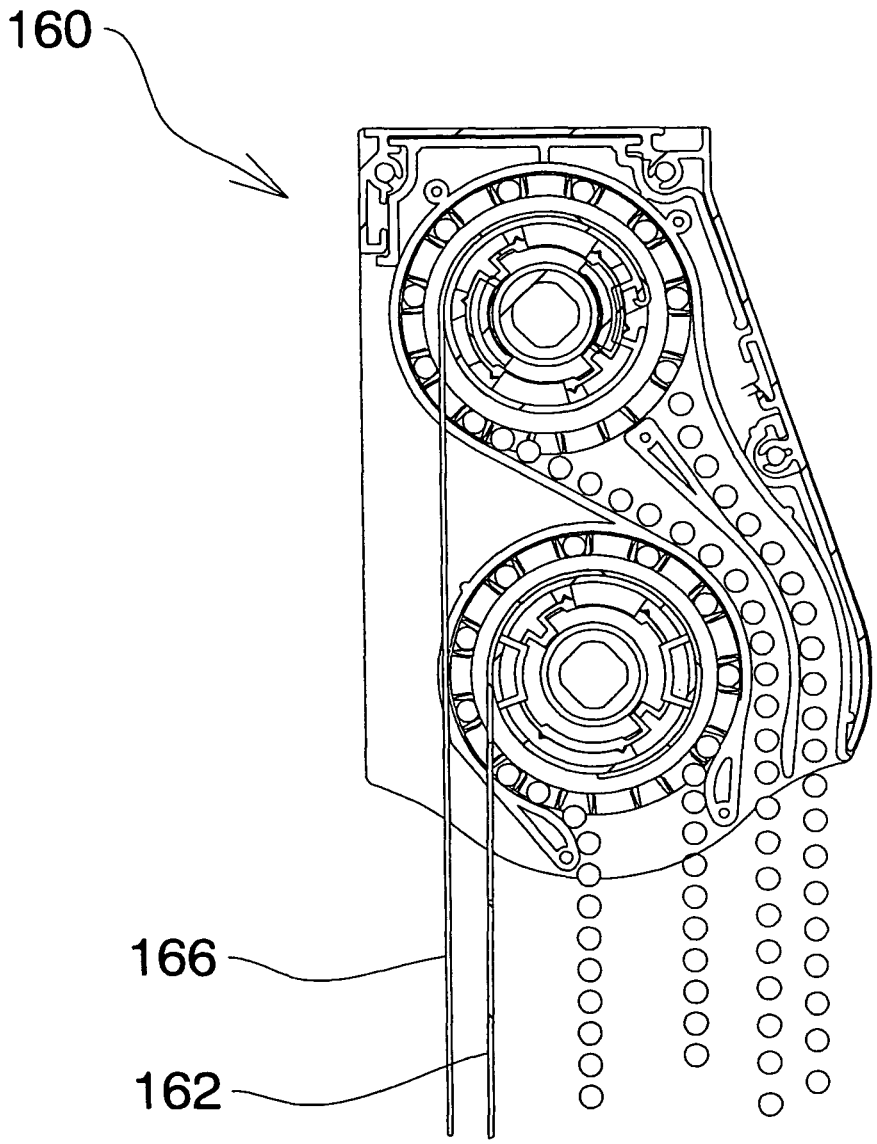
FIG. 9 is a side elevation of another embodiment, showing both first and second panels as being material wound onto rollers.

Suitable control cords (not shown) are provided (not shown), similar to FIG. 7. Another embodiment is shown in FIG. 9.

In this case the head rail (160) is similar to FIGS. 1 to 5, with guides for the control cords, as already described.

In this case the front panel (162) is a simple single panel of semi translucent material, which may, for example be of natural origin, such as bamboo, or other semi translucent fabrics such as are well known.

The second panel (166) is of dark effect opaque material, as before.

Suitable controls operate the respective first and second panels, as before.

Figure 10:
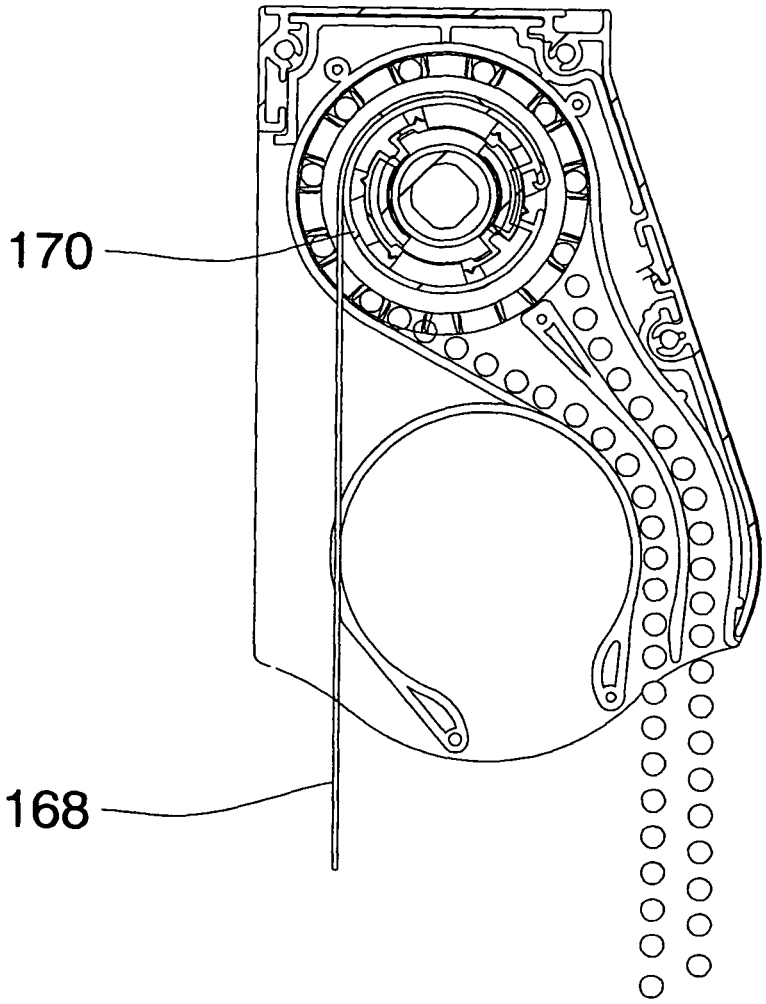
FIG. 10 is a side elevation of another embodiment, showing the head rail of the previous embodiment adapted for use with a single blind panel, with control elements hanging forwardly of the blind panel.

FIG. 10 shows essentially the same embodiment as FIG. 9, but in this case only the one blind panel (168) is shown, on a single roller (170). The head rail is of the same design as FIG. 9, but the space for the front roller, of FIG. 9, is simply unused.

Figure 11:
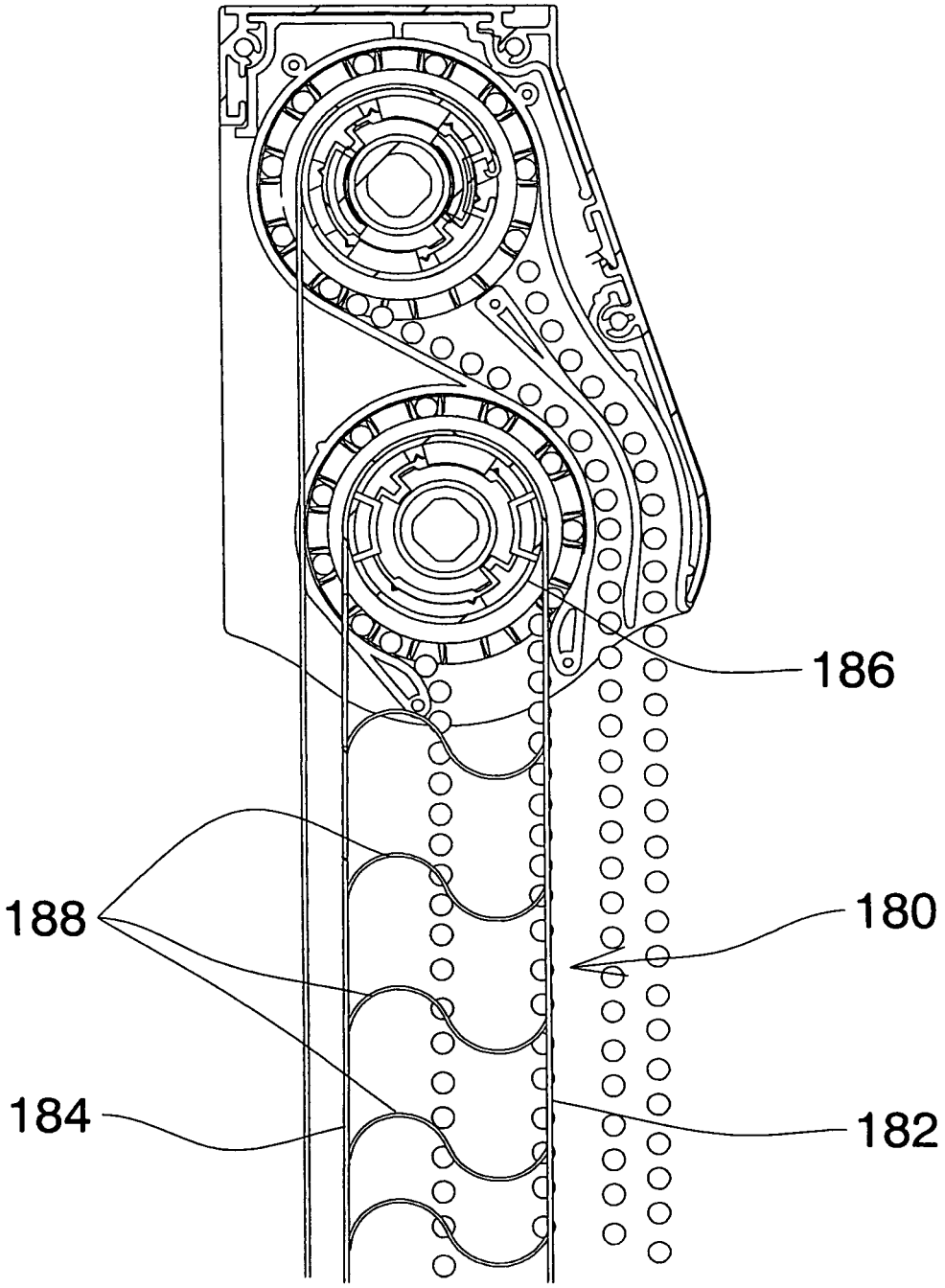
FIG. 11 is a side elevation of another embodiment, showing a front blind panel formed of two sheets of translucent material, with transverse strips extending between the two sheets, and showing a second dark blind panel.

Another embodiment is shown in FIG. 11.

This appears to be similar to the FIG. 2 embodiment.

However in this case the front or first panel (180) consists of two separate sheets of semi translucent material (182) and (184). The two sheets hang from the same roller (186). The two sheets are in fact adapted to be wound up, or lowered from the one roller (186).

Between the two sheets there are a plurality of transverse strips (188) of generally S-shaped configuration. The strips (188) are bonded or joined in other ways, to respective sheets (182) and (184).

The roller control mechanism is of a type known per se, and permits the two sheets to be arranged to hang as shown in FIG. 11, so that they are separated from each other, with one sheet wound up on one side of the roller, and the other sheet wound up on the other side of the roller.

When in this configuration the transverse strips are displaced apart from each other as shown in FIG. 11.

This permits a greater amount of light to pass through the two sheets, into the interior of the building.

By manipulation of the roller, the two sheets (182) and (184) can be displaced relative to one another, so that they will hang from the same side of the roller. This will cause the strips (188) to become rearranged so that they lie in more or less a vertical arrangement. The edges of the strips will register or overlap. This will block passage of more light, giving greater privacy.

Channels (190) and (192) are formed in roller (186) and receive the edges of respective sheets (182) and (184).

The second panel (194) hangs from upper roller (196), and is formed from opaque dark effect material. In this way the front panel can be manipulated, to provide more or less light, and gives a decorative appearance.

Panel (194) can be lowered when light exclusion is required.

Figure 12:
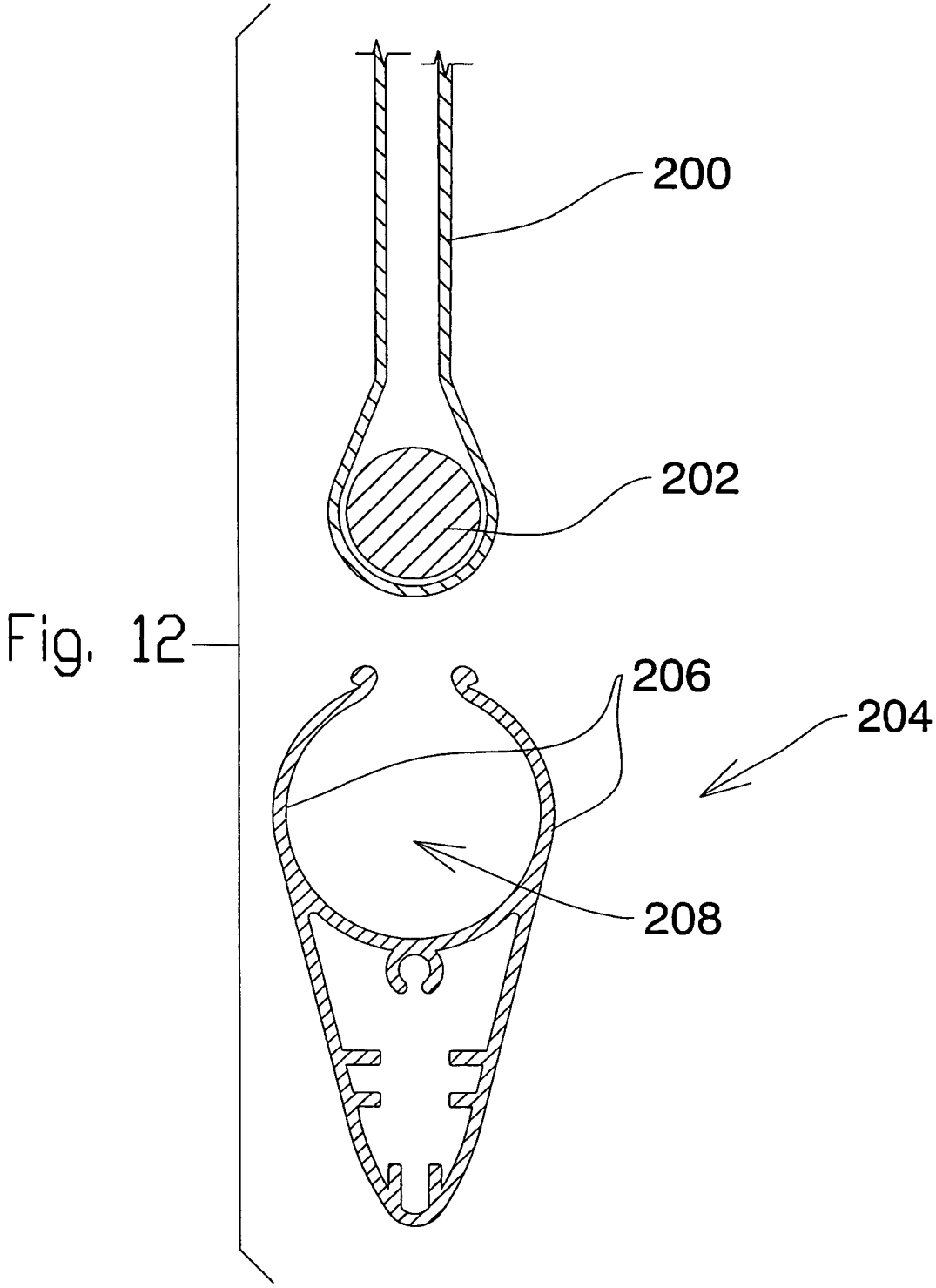
FIG. 12 is a side elevation of another embodiment, showing a front blind panel, formed into a loop and passing around a roller in the bottom rail.

FIG. 12 is a side elevation of another embodiment, showing a front blind panel (200), formed into a loop and passing around a roller (202) in the bottom rail (204)

The bottom rail has two semi cylindrical walls (206) defining a semi-cylindrical channel (208), with an upwardly directed open mouth (210). The panel (200) fits around roller (202), and is trapped between walls (206), but is free to rotate with roller (202) within channel (208).

Figure 13:
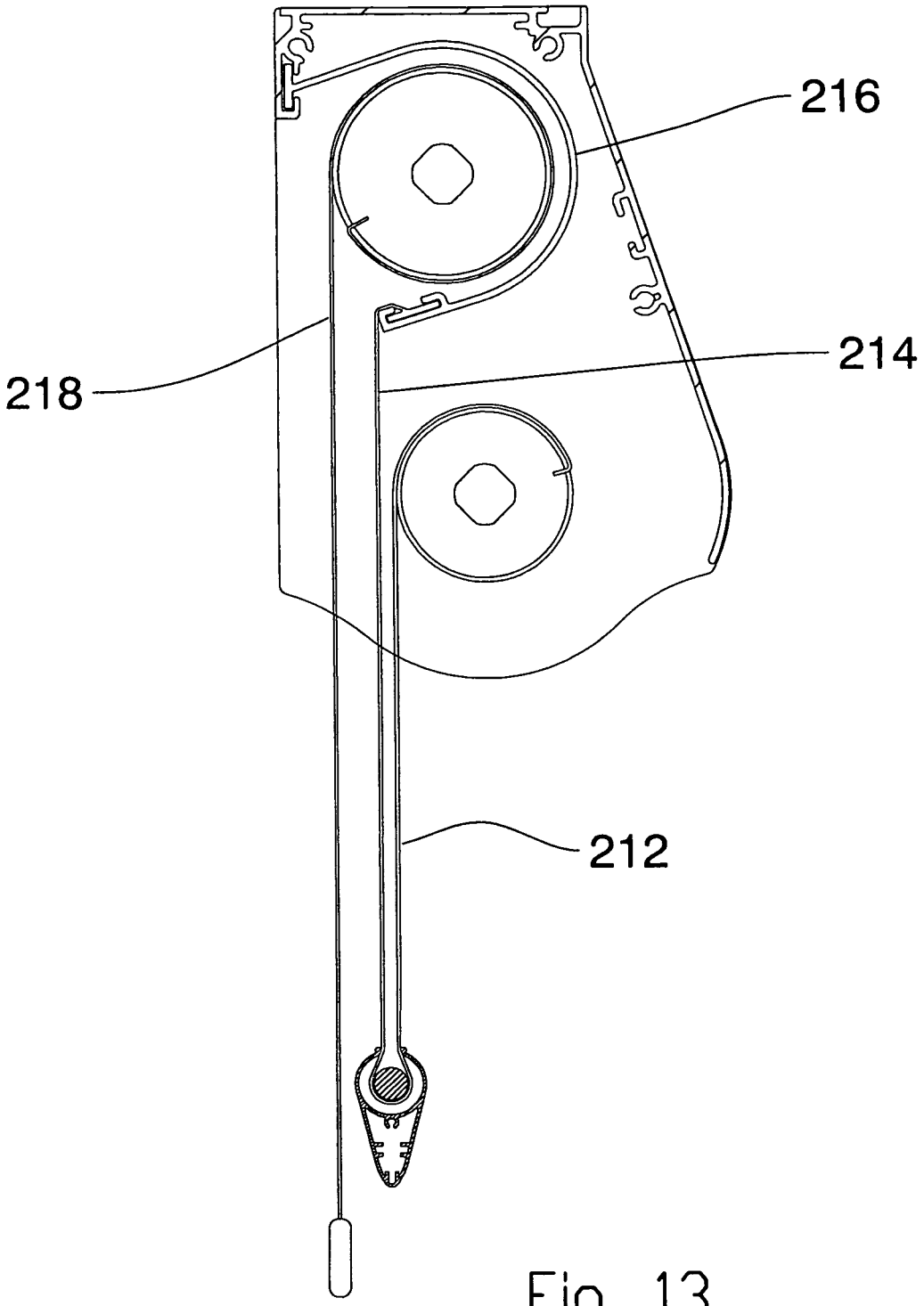
FIG. 13 is a side elevation of another embodiment, showing a front blind panel in the form of a loop with its free end secured in the head rail, on a semi circular wall.

FIG. 13 is a side elevation of another embodiment, showing a front blind panel (212) in the form of a loop with its free end (214) secured to on a semi circular wall (216), formed of metal, or extruded thermoplastic. The wall is secured to the interior of a rear portion of the head rail. Its shape enables it to encircle the upper roller and dark blind (218), without contact.

Figure 14:
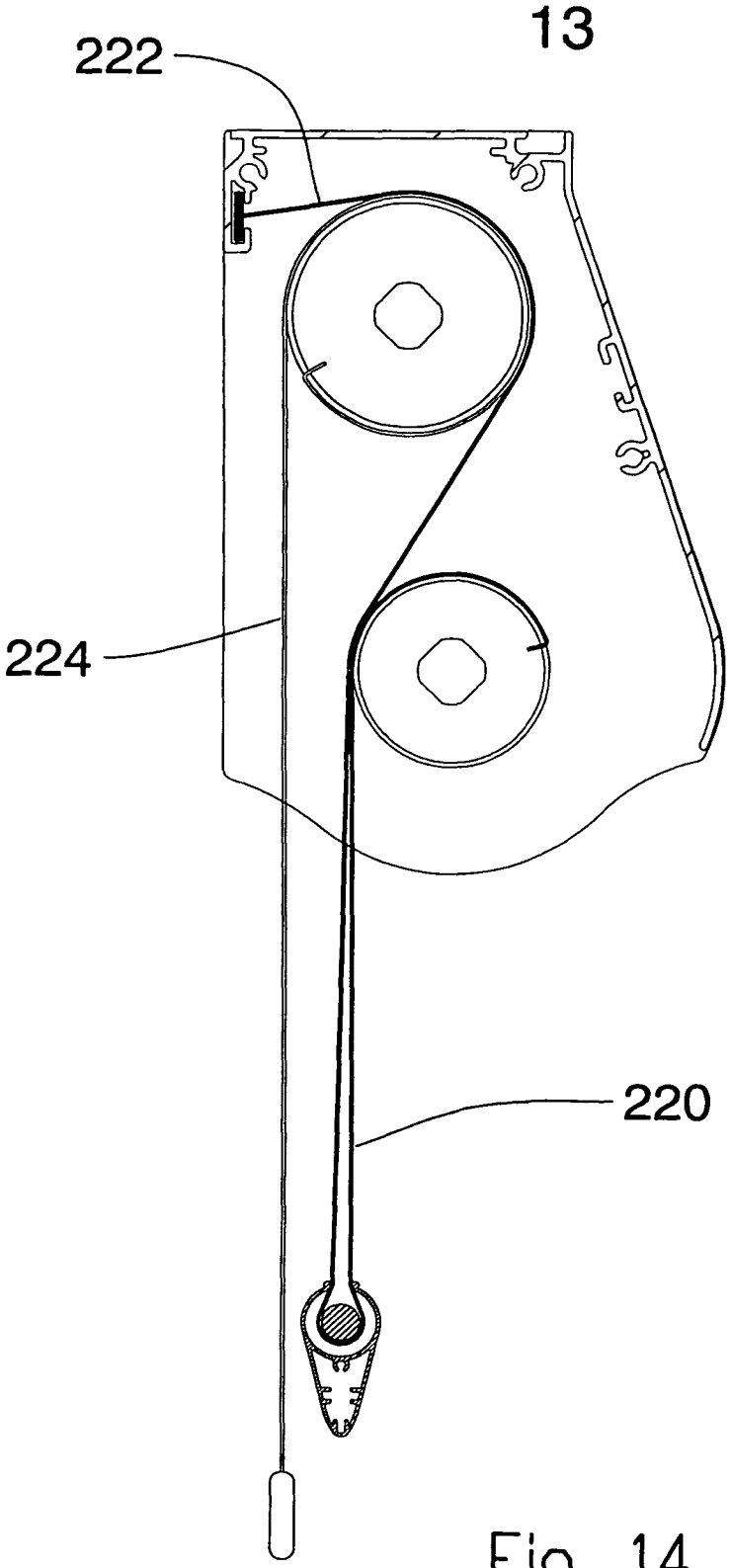
FIG. 14 is a side elevation of another embodiment, showing a front blind panel in the form of a loop, with its free end attached to a rear wall of the head rail.

FIG. 14 is a side elevation of another embodiment, showing a front blind panel (220) in the form of a loop, with its free end (222) attached directly to a rear wall of the head rail in this embodiment the panel (220) will actually contact the dark blind panel (224) on upper and also the front panel (220) on the lower roller. This may result in some wear, if the panels are adjusted frequently, but may be satisfactory for some circumstances.

Figure 15:
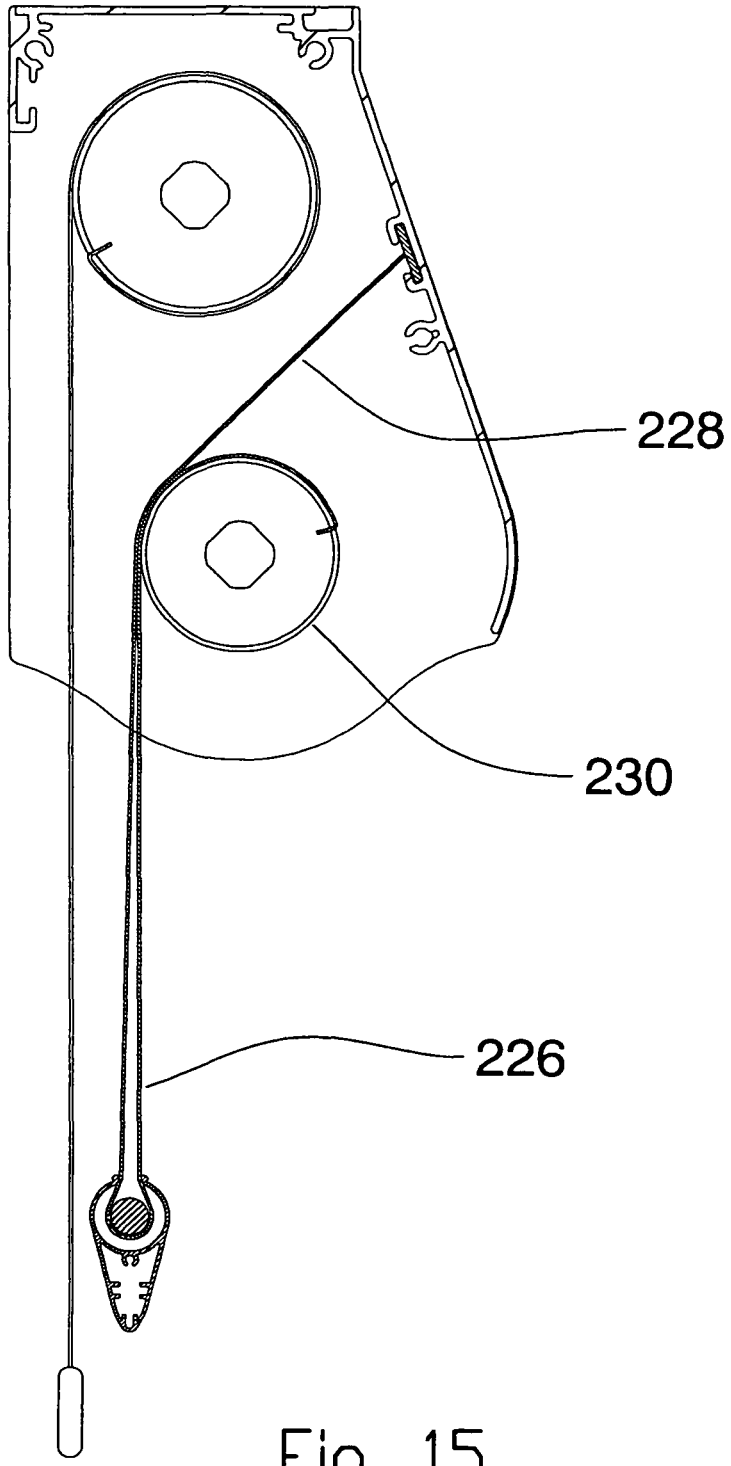
FIG. 15 is a side elevation of another embodiment, showing a front blind panel in the form of a loop with its free end attached to a front wall of the head rail.

FIG. 15 is a side elevation of another embodiment, showing a front blind panel (226) in the form of a loop with its free end (228) attached to a front wall of the head rail.

In this case the front panel will be in contact itself, where the free end runs around lower roller (230), but will not contact the dark panel on the upper roller.

Figure 16:
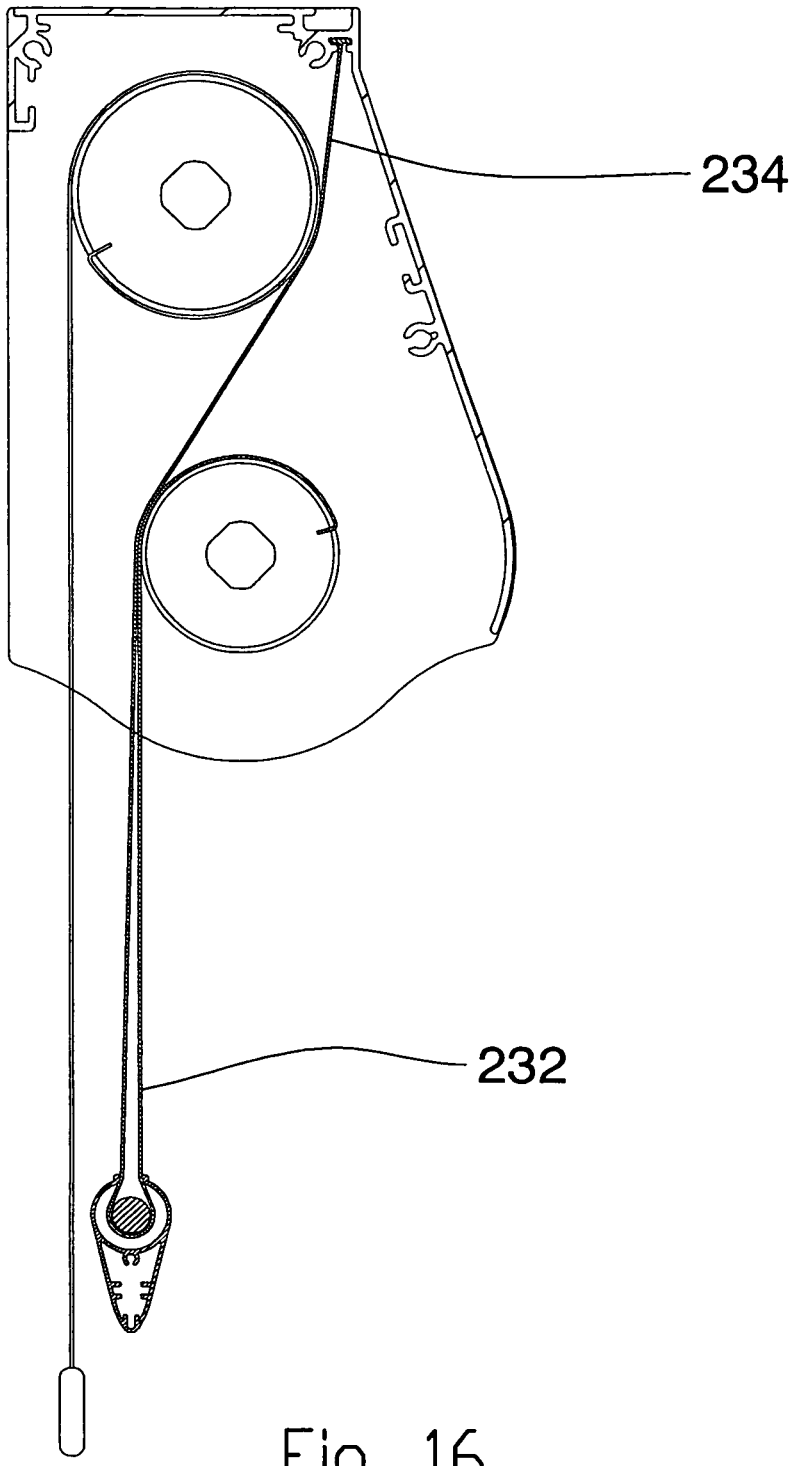
FIG. 16 is a side elevation of another embodiment, showing a front blind panel in the form of a loop with its free end secured to the top wall of the head rail.

FIG. 16 is a side elevation of another embodiment, showing a front blind panel (232) in the form of a loop with its free end (234) secured to the top wall ( ) of the head rail. In this case there will be some slight contact between the free end (234) and both the dark blind on the upper roller, and with the front panel on the lower roller. However since the two contact areas are relatively small, the wear will be slight.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A blind for a building opening, and comprising;

an elongated channel shaped head rail, attachable adjacent the building opening, said head rail defining upper and lower regions, and;

defining a front wall, a top wall, and a back wall, an upper blind roller, located in said upper region of said head rail, a lower horizontal support wall secured to and extending along said front wall, and forwardly of the front wall of said head rail;

a generally linear elongated horizontal attachment member attached to said lower horizontal support wall of said head rail, an upper blind stored on said upper blind roller, a lower blind carried on said horizontal attachment member, wherein said lower blind includes a plurality of vertical strips, and trolleys carried by said horizontal member for respective said vertical strips;

upper blind control mechanism operable to lower and raise said upper blind, lower blind control mechanism operable to operate said lower blind, wherein said upper blind roller is located with an upper axis along an upper plane in said head rail and said lower blind attachment member is located on a lower axis along a lower plane said axes being displaced vertically from one another, and wherein said upper blind is operable to depend down beside a predetermined side of said lower blind attachment member, and wherein said lower blind is operable alongside but spaced from said upper blind, whereby to provide a head rail having a slim, aesthetically pleasing profile.

2. A blind for a building opening as claimed in claim 1 wherein said upper blind is an opaque black out blind, whereby when said upper blind is raised, some light will pass in, and wherein when said upper blind is lowered light is substantially excluded.

3. A blind for a building opening as claimed in claim 1 wherein said horizontal member is a transverse elongated linear blind track for carrying said trolleys.

4. A blind for a building opening as claimed in claim 1 wherein said horizontal support wall is formed as an integral part with said front wall of said head rail.

5. A blind for a building opening as claimed in claim 1 wherein said horizontal support wall is formed integrally with said front wall and extends forwardly of said front wall.

6. A blind for a building opening as claimed in claim 5 including a vertical wall formed integrally with said horizontal support wall, and supporting a decorative trim strip.

* * * * *